United States Patent [19]

Weydt et al.

[11] Patent Number: 4,505,188

[45] Date of Patent: Mar. 19, 1985

[54] PNEUMATIC ACTUATOR

[75] Inventors: Willy V. D. Weydt, Toenisvorst; Ulrich Hannen, Willich; Herbert Paetzel, Nettetal, all of Fed. Rep. of Germany

[73] Assignee: McGraw-Edison Company, Rolling Meadows, Ill.

[21] Appl. No.: 504,964

[22] Filed: Jun. 16, 1983

[30] Foreign Application Priority Data

Jul. 3, 1982 [DE] Fed. Rep. of Germany ..... 3224905

[51] Int. Cl.[3] ..... F01B 19/02; F16F 1/06

[52] U.S. Cl. ..... 92/94; 92/59; 92/99; 92/130 D; 267/179

[58] Field of Search ..... 92/59, 60, 94, 130 D, 92/130 A, 84, 95, 132, 133, 99; 267/170, 178, 179

[56] References Cited

U.S. PATENT DOCUMENTS

| | | | |
|---|---|---|---|
| 2,781,776 | 2/1957 | Gratzmuller | 92/95 |
| 2,883,998 | 4/1959 | Broughton | 92/95 |
| 2,950,739 | 4/1960 | Lofink | 92/95 |
| 3,166,251 | 1/1965 | Stitt, Sr. et al. | 92/94 |
| 3,241,805 | 3/1966 | Schumann | 92/95 |
| 3,815,471 | 6/1974 | Kobelt | 92/130 D |
| 3,862,751 | 1/1975 | Schwaller | 267/179 |
| 3,866,521 | 2/1975 | Weber | 92/133 |
| 4,046,167 | 9/1977 | Papp et al. | 92/130 D |
| 4,258,611 | 3/1981 | Detweiler | 92/84 |

FOREIGN PATENT DOCUMENTS

| | | |
|---|---|---|
| 1911002 | 1/1974 | Fed. Rep. of Germany . |
| 0084325 | 3/1920 | Switzerland . |

*Primary Examiner*—Robert E. Garrett
*Assistant Examiner*—H. Edward Li
*Attorney, Agent, or Firm*—Jon Carl Gealow; James A. Gabala; Hugh Gilroy

[57] ABSTRACT

A pneumatic positioner with a casing composed of a shell-like bottom part and a shell-like cover part. A membrane plate, is connected through a gas-tight membrane with the side walls of the casing so as to be movable back and forth in the casing in the direction of a drive spindle which is disposed in sealing relationship through the bottom part of the casing. In the bottom part and/or in the cover part, there are arranged one or more gas-conducting connecting pieces. In the casing there are arranged coil springs for producing biasing or restoring forces. These springs abut, on the one hand, the membrane plate and, on the other hand, the bottom part or cover part. On the membrane plate of one embodiment there is provided for each coil spring at least two supporting surfaces which present different spacings from a plane perpendicular to the direction of motion of the drive spindle and upon which the coil springs are replaceably disposed. In this manner it is possible to vary the restoring forces, without its being necessary to change either the number of coil springs or the spring constant of the coil springs then in use.

9 Claims, 2 Drawing Figures

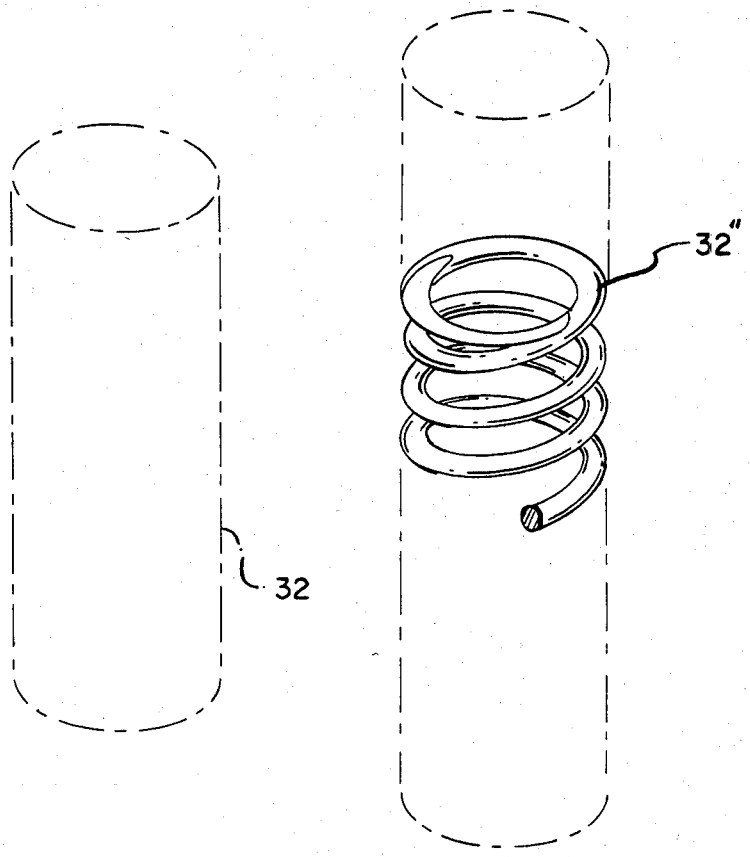
FIG. 2
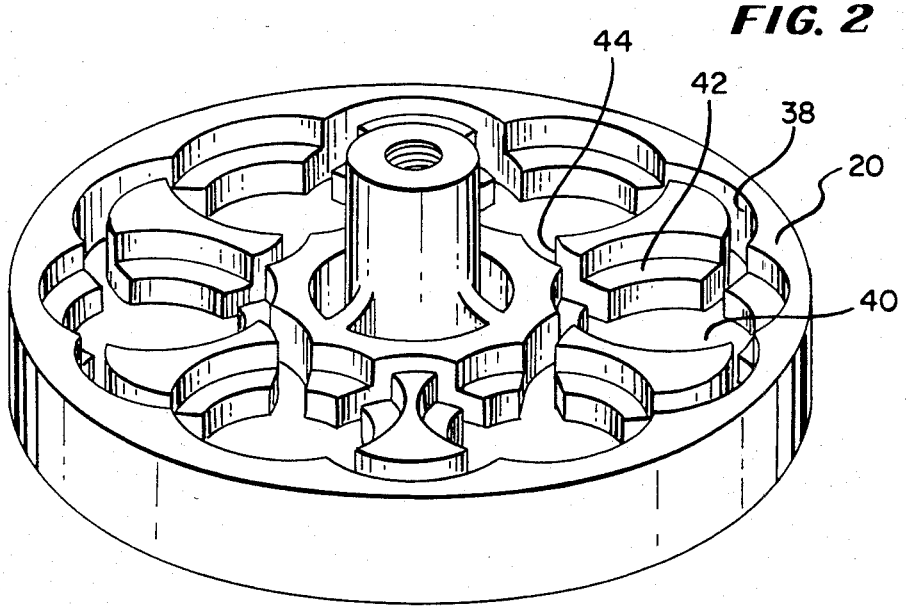

PNEUMATIC ACTUATOR

TECHNICAL FIELD

This invention is related to the general subject of positioners or actuators and to pneumatic positioners, in particular.

BACKGROUND OF THE INVENTION

Pneumatic positioners generally include: a thin walled casing composed of a shell-like bottom part and a shell-like cover part; a membrane or diaphragm plate which is connected by means of a gas-tight membrane or diaphragm to the side walls of the casing halfs so as to be movable back and forth in the casing; a drive shaft or spindle which is connected to the membrane plate and which is disposed in a sealing relationship through the bottom part of the casing; gas feed connecting pieces disposed within the bottom part and/or in the cover part; and a set of casing coil springs abutting, on one hand, the membrane plate and, on the other hand, the bottom part or cover part of the casing so as to produce a biasing force.

Such pneumatic positioners are well known to those skilled in the art. They are used, for example, to actuate valves, slides and other linkages. It is a common practice in the use of such pneumatic positioners to adjust the effective restoring force or biasing force either by changing the number of coil springs arranged in the casing between membrane plate and/or cover part or bottom part, or by changing the spring constant of the coil springs. This practice is inefficient in that an inventory of coil springs has to be kept in readiness in a location separate from those used within the positioners. This is especially burdensome if many positioners are in use throughout one's plant; considerable storage space would have to be provided. Moreover, there is always present the danger that the coil springs stored outside the pneumatic positioner will be lost or misplaced. Thus, it is more than desirable to have a pneumatic positioner whose spring bias may be easily adjusted without having to physically replace the coil springs arranged in the positioner's casing.

SUMMARY OF THE INVENTION

The invention makes use of the insight that one may adjust the biasing force on the membrane plate of a positioner by changing the tension with which the coils springs in the casing are acted upon. This is achieved according to the invention by providing a means by which each coil spring is arranged within the casing, at least on one side of the spring, so as to have at least two supporting surfaces which have a prescribed axial spacing from one another. Thus, different biasing forces are provided, depending on which supporting surface is used in conjunction with the coil springs in the casing. The restoring or biasing forces so provided thus generated depend on the supporting surface chosen.

In accordance with the present invention, an alteration of the biasing forces can be achieved, simply by shifting one or more of the springs from one supporting surface to a supporting surface present in another position. This may be achieved without having to exchange, charge or remove the springs already in use. The supporting surfaces can be arranged in an extremely space saving manner on the membrane plate in the casing.

Numerous other advantages and features of the present invention will become readily apparent from the following detailed description of the invention, from the claims and from the accompanying drawings.

BRIEF DESCRIPTION OF THE DRAWINGS

FIG. 2, is a perspective representation of a membrane plate, with coil springs arranged over it, adapted for use with the positioner shown in FIG. 1.

DETAILED DESCRIPTION OF THE PREFERRED EMBODIMENTS

Figure 1:
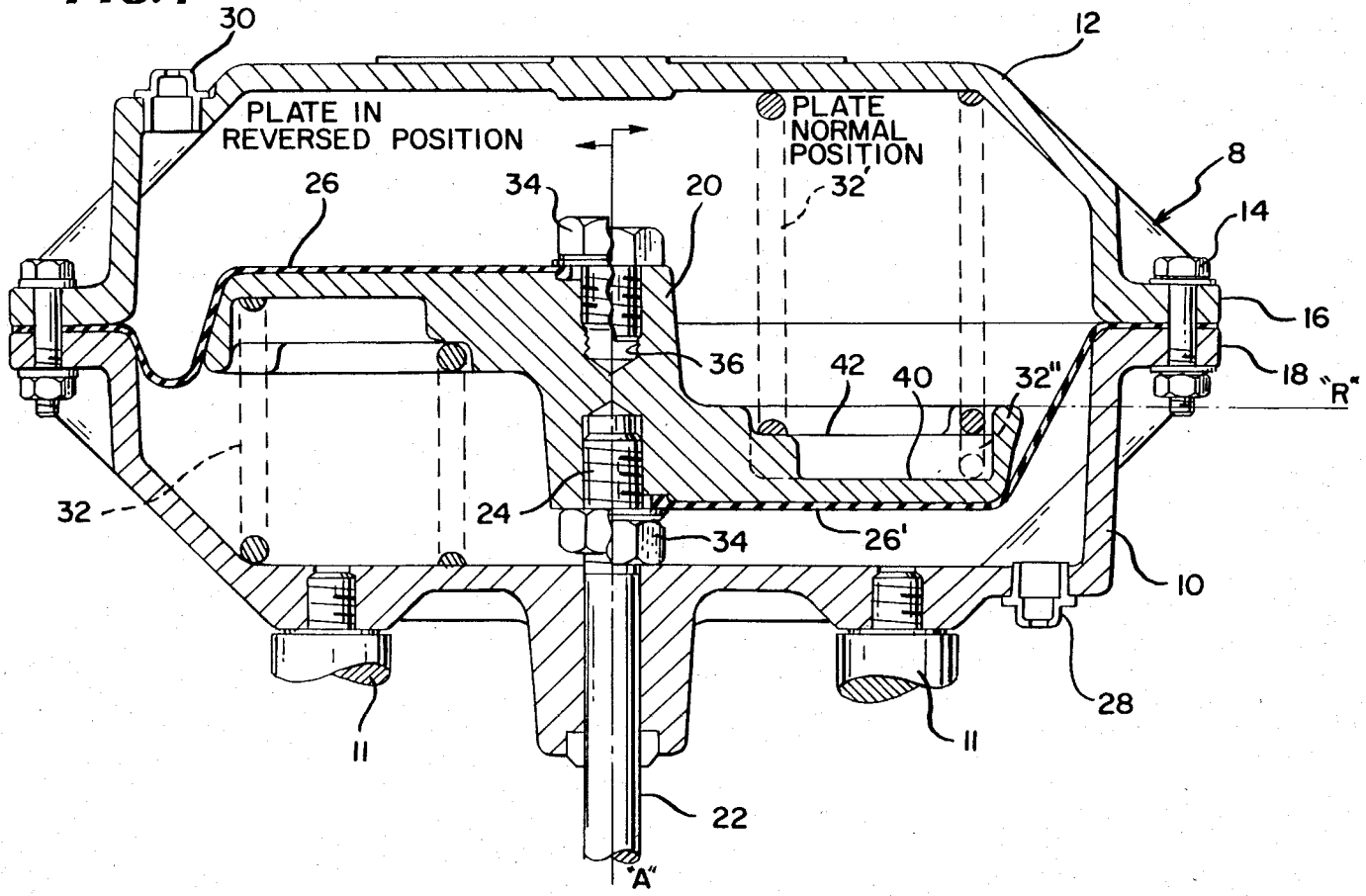
FIG. 1, is a cross-sectional, side elevational view of a pneumatic positioner incorporating the present invention, the right half of the drawing showing one position of the membrane plate, and the left half of the drawing showing the membrane plate reversed.

While this invention is susceptable of embodiment in many different forms, there are shown in the drawings and will herein be described in detail several preferred embodiments of the invention. It should be understood, however, that the present disclosure is to be considered as an exemplification of the principles of the invention and is not intended to limit the invention to the specificate embodiments illustrated.

The pneumatic setting gear or positioner represented in FIG. 1 has a casing 8 which is composed of a shell-like bottom part 10 and a shell-like cover part 12. The two casing parts 10 and 12 are joined by threaded fasteners 14 on two abutting flanges 16 and 18. In the interior of the casing 8 there is arranged a membrane plate 20, to which there is fastened a shaft or spindle 22 also by means of a threaded connection or bore 24. The spindle 22 is conducted, with sealing effect, through the bottom part 10 and is adapted to be joined (in a manner not illustrated) to a setting member (e.g., valve stem, etc.). The bottom part 10 is supported by a yoke arms 11.

Turning to the left-hand side of FIG. 1, a membrane 26 is shown disposed atop the membrane plate 20. The membrane plate is joined with the side walls of the casing 8 in such a manner that the outer edge of the membrane is clamped between the casing flanges 16 and 18. The membrane plate 20 in this manner is free to move up and down in the casing 8 in the direction of the axis "A" of spindle 22. In the bottom part 10 there is also arranged a gas feed connecting piece 28. In the cover part 12, a similar gas feed connecting piece 30 is located. Depending on which of the two gas feed connecting pieces 28 or 30 is supplied with compressed air or gas, the membrane plate 20 moves upwardly or downwardly. In either case this motion is opposed by the restoring or biasing force provided by a set of coil springs 32. These springs 32 are disposed within one of the casing halfs 10, 12. They are supported, on the one hand, by the membrane plate 20 and, on the other hand, by either the bottom part 10 or the cover part 12.

The membrane plate 20 can be arranged in two different positions within the casing 8. These two positions are represented in the left and right sides or halves of FIG. 1. In the left half of FIG. 1, the membrane plate 20 is disposed in such a way that the membrane 26 (which is shown fastened to the membrane plate by means of a threaded fastener 34 inserted into a bore 36 of the membrane plate) is on the upper side and the coil springs 32 abut the membrane plate and the bottom part 10. In this arrangement the spindle 22 is on that side carrying the spring supporting surfaces of the membrane plate 20. In the right half of FIG. 1, the membrane plate 20 is installed in the casing 8 in such a way that the membrane 26 is on the side facing the bottom part 10. Here the membrane 26 is secured with the end of the spindle 22 joined to the bore 24 in the membrane plate 20. The coil springs 32 abut, on one hand, the membrane plate 20 and, on the other hand, the cover part 12. Thus, by reversing the position of the membrane plate 20, the biasing force applied to the spindle 22 is changed. In the case of a valve positioner this enables one to change the force with which the valve disk is held open or shut.

The more precise construction of the membrane plate 20 on which the coil springs 32 abut, is represented in FIG. 2. The circularly formed membrane plate 20 presents, on the side on which the coil springs 32 are to be supported, substantially circular recesses 40 and grooves 38 and 44 which pass through or intersect one another in the circumferential direction. The recesses 40 have on their edges substantially circular annular graduations 42. The bottom of the recesses 40 is disposed at a greater distance from the upper surface "R" (i.e., the reference surface of the membrane plate 20 in FIG. 1) than the surface of the associated edge graduations 42. Thus, depending on whether one of the coil springs 32 is installed on the graduations 42 of the recesses 40 or in the grooves 38 and 44 (in which case it rests on the groove bottoms), the coil spring is installed more or less deeply into the membrane plate 20. From FIG. 1 it should be clear that a coil spring 32'' which is disposed to rest on the bottom of the grooves 38 and 44, with respect to the same position of the membrane plate 20, brings about a lower restoring or biasing force than when a spring 32' is seated on the supporting surface of the edge graduations 42 or on one of the recess 40 bottoms.

From the foregoing, it will be observed that numerous variations and modifications maybe equally effective without departing from the true spirit and scope of the novelty concept of the invention. For example, through use of coil springs 32, either in the grooves 38 and 44 or on the graduations 42 of the recesses 40, is possible to provide for a variety of different restoring forces. In the specific embodiment illustrated, supporting surfaces are provided which have two different spacings in respect to the reference surface "R" of the membrane plate 20. It should also be clear that multiple springs may be nested together. Up to six coil springs 32 may be used with the membrane plate 20 illustrated. Moreover, all the coil springs 32 may be installed in the grooves 38 and 44 or all the coil springs may be installed in the recess 40 bottoms, or a part of the coil springs may be installed in the grooves and the remaining part of the coil springs may be installed in the recesses. Clearly, there are other variations, depending on whether or not all of the coil springs are used. It is also possible, obviously, to provide still further supporting surfaces, which have a different spacing from the surface "R" than the bottom of the grooves 38 and 44 or the edge graduations 42 of the recesses 40 in which, for example, there are worked still further circular grooves with a still deeper groove bottoms relative to the membrane plate 20. Thus it is to be understood that no limitation with respect to the specificate apparatus illustrated herein is intended or should be inferred. It is, of course, intended to cover by the appended claims all such modifications has fall within the scope of the claims.

We claim:

1. A pneumatic positioner, comprising:

(a) a walled casing composed of a shell-like bottom part and a shell-like cover part;

(b) a membrane plate disposed within said casing and defining two sides;

(c) a gas-tight membrane, disposed between said bottom part and said cover part and disposed against one side of said membrane plate, for dividing the interior of said casing into two chambers;

(d) a spindle, conducted sealingly through the bottom part of the casing and connected to said membrane plate, for moving said membrane plate towards and away from said bottom part;

(e) gas feed connecting pieces in at least one of said bottom part and said cover part; and (f) at least two coil springs disposed within said casing in an abutting relationship with the other side of said membrane plate and one of said bottom part and said cover part, said membrane plate defining at least two radially disposed supporting surfaces for each of said two coil springs, each of said surfaces being axially disposed at different distances from a reference plane which is disposed perpendicular to the direction of motion of said spindle, whereby for a pre-selected position of said spindle the biasing force applied to the said membrane plate to oppose the motion of said spindle depends on the location of said springs relative to their two respective supporting surfaces.

2. The pneumatic positioner according to claim 1, wherein said supporting surfaces for each of said two coil springs are defined by at least one circular groove and a circular recess defined within said other side of said membrane plate.

3. The pneumatic positioner according to claim 1, wherein said two radially disposed supporting surfaces are defined by a plurality of substantially circular radial disposed grooves and circular recesses which are defined within said other side of said membrane plate.

4. The pneumatic positioner according to claim 3, wherein said grooves and recesses are disposed in an overlapping intersecting relationship.

5. The pneumatic positioner according to claim 4, wherein said membrane plate defines, alternatingly in the circumferential direction, first supporting surfaces on the bottom of said substantially circular grooves and second supporting surfaces on substantially arcuate graduations disposed within said circular recesses, said grooves intersecting through said recesses and said second supporting surfaces.

6. The pneumatic positioner set forth in claim 5, wherein the depth of said grooves is equal to the depth of said recesses, and wherein said graduations are arranged at a prescribed axial distance from the base of the grooves and the bottom of the recesses.

7. A pneumatic positioner, comprising:

(a) a hollow casing defining a peripheral wall;

(b) a substantially circular membrane plate defining a center and disposed within said casing so as to be free to move between a first position and a second position, said membrane plate defining two supporting surfaces which are radially disposed from said center and axially spaced from one another and from a reference plane which is perpendicular to the direction of movement of said membrane plate;

(c) a flexible diaphragm disposed between said peripheral wall of said casing and said membrane plate so as to form a pressure seal between the membrane plate and the casing while freeing the membrane plate to move within the casing;

(d) a gas connection carried by said casing and disposed on one side of said membrane plate; and (e) removable biasing means, disposed between one of the two surfaces of said membrane plate and said casing.

8. The pneumatic positioner of claim 7, wherein said two radially disposed supporting surfaces are disposed along the circumference of said membrane plate, and wherein said biasing means includes at least two generally similar coil springs.

9. A pneumatic positioner, comprising:

(a) a walled casing composed of a shell-like bottom part in a shell-like cover part;

(b) a cast generally circular membrane plate disposed within said casing and defining two sides;

(c) a gas-tight membrane, disposed between said bottom part and said cover part and disposed against one side of said membrane plate, for dividing said casing into two pressure chambers;

(d) a central spindle, conducting pressure sealingly through said bottom part of said casing and connected to the center of said membrane plate, for transferring the motion of said membrane plate towards and away from said bottom part;

(e) gas feed connecting pieces in at least one of said bottom part and said cover part; and (f) a plurality of helically wound coil springs radially disposed within said casing in an abutting relationship with one of two supporting surfaces defined within the other side of said membrane plate, one of said surfaces being defined by a plurality of circular recesses which are arranged circumferentially at generally the same radial distance from the center of said membrane plate and which have a radius generally the same as said coil springs, said one surfaces being connected to the each other by a plurality of generally circular grooves of approximately the same radius as the radius of said circular recesses, the other of said two supporting surfaces being defined by a plurality of substantially arcuate graduations disposed within said circular recesses and bounded by said circular grooves.

* * * * *